US006978820B2

(12) United States Patent
Aoki

(10) Patent No.: US 6,978,820 B2
(45) Date of Patent: Dec. 27, 2005

(54) SLIDING SCREEN DOOR

(75) Inventor: Takashi Aoki, Shizuoka (JP)

(73) Assignee: Seiki Juko Co., Ltd., Shizuoka (JP)

( * ) Notice: Subject to any disclaimer, the term of this patent is extended or adjusted under 35 U.S.C. 154(b) by 0 days.

(21) Appl. No.: 10/491,900

(22) PCT Filed: Oct. 29, 2002

(86) PCT No.: PCT/JP02/11215

§ 371 (c)(1),
(2), (4) Date: Apr. 16, 2004

(87) PCT Pub. No.: WO03/038226

PCT Pub. Date: May 8, 2003

(65) Prior Publication Data

US 2004/0244919 A1 Dec. 9, 2004

(30) Foreign Application Priority Data

Oct. 30, 2001 (JP) ..... 2001-332797
Aug. 20, 2002 (JP) ..... 2002-239753

(51) Int. Cl.[7] ..... E06B 3/94
(52) U.S. Cl. ..... 160/84.06
(58) Field of Search ..... 160/84.06, 84.04, 160/84.05, 265, 201, 271, 272

(56) References Cited

U.S. PATENT DOCUMENTS 4,862,941 A * 9/1989 Colson ..... 160/84.02
5,377,737 A * 1/1995 Moriya et al. ..... 160/84.06
5,456,303 A * 10/1995 Horinouchi ..... 160/84.04
5,873,401 A * 2/1999 Tsuchida ..... 160/84.04
6,152,205 A * 11/2000 Toti ..... 160/84.04
6,186,212 B1 * 2/2001 Tsuchida ..... 160/84.06
6,318,438 B1 * 11/2001 Uno et al. ..... 160/31

FOREIGN PATENT DOCUMENTS

JP 2569974 2/1998
JP 2000-230381 8/2000
JP 2000-352280 12/2000

* cited by examiner

*Primary Examiner*—David Purol
(74) *Attorney, Agent, or Firm*—Oblon, Spivak, McClelland, Maier & Neustadt, P.C.

(57) ABSTRACT

The invention provides a sliding screen door having a net guide that moves in association with the opening and closing movement of a net, wherein the opening and closing operation of the screen door can be performed smoothly while providing a buffering effect with an adequate resistance, without hindering the opening and closing operability of a movable edge member, by enabling a reaction force, which is required for its bending, to be used as a buffering force against the operating force of the movable edge member, the net guide being formed by connecting guide pieces. In order to do so, a net guide 12 fed out from and drawn into the lower end of the vertical frame member 6 in association with the opening and closing operation of the net 4, is provided for guiding the lower end of the net 4. The net guide 12 is formed by connecting with a tape member 16 a number of guide pieces 14 formed substantially into a U-shape with a bottom portion 14*a* and a stabilizing portion 14*b*. The tape member 16 is inserted into the insertion devices 14*c* on the guide pieces 14 and the guide pieces 14 at both ends are fixed to the tape member 16.

20 Claims, 10 Drawing Sheets

SLIDING SCREEN DOOR

TECHNICAL FIELD

The present invention relates to a screen door in which elastic net folded alternately back and forth can be opened and closed by a sliding movement and, more specifically, to a sliding screen door having a net guide that is drawn out along the lower end of the net in association with the opening and closing operation of the net.

BACKGROUND ART

A screen door constructed in such a manner that the left and right sides of a net, which is folded alternately back and forth and hence is elastic, are attached to a vertical frame member of a screen door frame and to a movable edge member for the opening and closing operation, and the aforementioned net is opened and closed by sliding the movable edge member, wherein a net guide that is drawn out from the lower end of either the aforementioned vertical frame member or the movable edge member along the lower end of the net in association with the opening and closing operation of the aforementioned net and that guides the lower end of the net for preventing the net from shaking, is conventionally known as disclosed, for example, in Japanese Patent No. 3007628.

The aforementioned conventional sliding screen door is effective in that a buffering effect is achieved by providing an adequate resistance, without hindering the opening and closing operability of the movable edge member, by allowing the aforementioned net guide, which is formed of extruded thermoplastic synthetic resin, to project from and retract into the lower end of the vertical frame member or of the movable edge member in a bent manner in association with the opening and closing operation of the net, and arranging for a reaction force, which is generated when bending against the operating force of the movable edge member, to be used as a force for the buffering action. However, it is necessary to use a resin having a sufficient durability against repeated bending and having an adequate resistance against bending as the material forming the aforementioned net guide, and thus the material is disadvantageously limited to certain types.

In particular, when the sliding screen door is applied to an insect screen door, part of the aforementioned net guide, that is, a stabilizing portion extending upward along the outer surface of the net is formed with a plurality of notches for providing flexibility to the aforementioned bottom portion. Therefore, those notches form spaces, and of course increasing the size of those notches may lead to a reduced ability to block insects.

In Japanese Unexamined Patent Application Publication No. 2000-145314, a screen door having the aforementioned net guide assembled by fitting together a series of projections and holes is disclosed. In the case of this type of net guide, it is troublesome to connect of each rigid unit, and in addition, a force for buffering the operating force of the movable edge member as in the case of the aforementioned net guide using extruded thermoplastic synthetic resin, cannot be generated.

DISCLOSURE OF THE INVENTION

An object of the present invention is to provide a sliding screen door having a net guide that moves in association with an opening and closing movement of a net, wherein the opening and closing operation of the screen door can be performed smoothly while providing a buffering effect with an adequate resistance, without hindering the opening and closing operability of the movable edge member, by enabling a reaction force of the net guide, which is generated when it bends, to be used as a force for buffering the operating force of the movable edge member, the net guide being formed by connecting guide pieces formed of a suitable resin.

Another object of the present invention is to provide a sliding screen door having an improved insect blocking effect by eliminating notches that have been required in conventional sliding screen doors by allowing the bottom portion of the net guide, which is formed of extruded material, to bent, thus achieving the net guide to bent without forming spaces between adjacent guide pieces.

Still another object of the present invention is to enable production of the aforementioned net guide, as well as a sliding screen door having the same, easily and as cheaply as possible.

In order to achieve the aforementioned object, the sliding screen door of the invention is a screen door constructed in such a manner that the aforementioned net can be opened and closed by attaching the left and right ends of the net folded back and forth alternately to provide elasticity to a vertical frame member of a screen door frame and a movable edge member for the opening and closing operation and sliding the movable edge, characterized in that the screen door includes a net guide for preventing shaking of the net by being drawn out from the lower end of either the aforementioned vertical frame member or the movable edge member along the lower end of the net in association of closing operation of the aforementioned net for guiding the lower end of the net, in that the net guide includes a plurality of guide pieces formed of synthetic resin into a substantially U-shape each having a bottom portion lying along the lower end of the aforementioned net and a stabilizing portion extending upward along the outer surface of the net, and a flexible tape member for connecting the guide pieces and is assembled by inserting the aforementioned tape member into insertion device formed along the bottom of each of the aforementioned guide pieces and fixing the guide pieces at both ends to the tape member.

In the aforementioned sliding screen door, the aforementioned net guide is preferably provided with a reverse-warp preventing mechanism for preventing the aforementioned net guide from bending in one direction. The reverse-warp preventing mechanism is formed by an abutting portion provided on each of the aforementioned guide pieces at a position lower than the aforementioned insertion device, so that the abutting portions of the adjacent guide pieces abut against each other when the aforementioned net guide is linearly drawn out along the lower end of the net. In this case, the aforementioned abutting portion may be formed of a surface facing the direction of connection of the aforementioned guide pieces.

It is effective to connect the aforementioned plurality of guide pieces so that the stabilizing portions of the guide pieces are connected with each other without forming a gap therebetween when the aforementioned net guide is linearly drawn out along the lower end of the net, and form a run-off for accommodating the stabilizing portion of the adjacent guide piece when the aforementioned net guide is bent and allowing the net guide to bend, or to determine the length of the aforementioned tape member to be longer than the total length of the aforementioned plurality of guide pieces in a connected state to an extent that allow the aforementioned net guide to bend.

In addition, it is preferable that the aforementioned guide pieces each include a hook-shaped connecting strip projecting from a position above the aforementioned abutting portion and having an extremity bent upward or downward, and a connected device with which the connecting strip of the adjacent guide piece detachably and rotatably engages, so that the adjacent guide pieces are connected with each other by engaging the aforementioned connecting strip and the connected device when the tape member is inserted into the aforementioned insertion device, and that the stabilizing portion of each of the aforementioned guide pieces is formed with the run-off for accommodating the stabilizing portion of the adjacent guide piece when the aforementioned net guide is bent to allow the net guide to bend. In this case, it is also possible to form the aforementioned connecting strip on the end surface of the bottom of the aforementioned guide piece so as to project therefrom, and form a connecting hole, in which the extremity of the aforementioned connecting strip is inserted, on the aforementioned connected device, which is formed on the bottom of the aforementioned guide piece.

It is also possible to provide the bottom of the aforementioned guide piece with a pair of guide ridges for sliding engagement with a guiding device formed on the floor surface of the doorway of a building at a corresponding position of the back surface thereof. In this case, the aforementioned guide ridges may be formed into a hook-shape so as to slidably engage with the recess groove formed on both sides of the aforementioned guiding device.

It is further possible to provide a net retaining piece having an engaging device at the lower end of the aforementioned net, and to provide the guide piece of the aforementioned net guide with an engaging projection that engages with the engaging device of the aforementioned net retaining piece.

In the sliding screen door having the construction as described above, the aforementioned net guide includes a plurality of guide pieces of synthetic resin of a substantially U-shape each having a bottom portion lying along the lower end of the net and a stabilizing portion extending upward along the outer surface of the net, and a flexible tape member for connecting the guide pieces, and is assembled by inserting the aforementioned tape member into insertion device formed along the bottom of each of the aforementioned guide pieces and fixing the guide pieces at both ends to the tape member. Therefore, a reaction force of the aforementioned tape member when being bent works as a force for buffering action against an operating force of the movable edge member, and thus buffering effect is achieved by providing an adequate resistant without hindering the opening and closing operability of the movable edge member. The flexible tape member may be any material such as an extruded thermoplastic synthetic resin.

In addition, since the stabilizing portion of the guide piece is formed with the run-off for accommodating the stabilizing portion of the adjacent guide piece, and thus the net guide can be bent without providing a space between the adjacent guide pieces. Therefore, notches that have been required in the conventional sliding screen door for enabling bending of the bottom portion of the net guide may be eliminated, and hence the insect-blocking effect may be improved. Furthermore, when the guide pieces are connected in such a manner that the abutting portions provided below the tape member insertion device abut against each other when the net guide is linearly drawn out along the lower end of the net, the net guide can be bent into an upwardly concaved shape for feeding in or drawing out the bent portion with respect to the vertical frame member or a movable edge member, but bending in the opposite direction may be prevented for avoiding impairment of smooth opening and closing operation due to lifting from the floor level. In this case, when the aforementioned guide piece includes a hook-shaped connecting strip projecting from a position above the aforementioned abutting portion and having an extremity bent upward or downward, and a connected device with which the connecting strip detachably and rotatably engages, the aforementioned net guide may be prevented further reliably from bending in the opposite direction and lifting from the floor level in association therewith.

Even when the run-off for accommodating the stabilizing portion of the adjacent guide piece when the aforementioned net guide is bent is not formed on the stabilizing portion of the aforementioned guide piece, the same action as that described above may be achieved only by providing a sufficient length to the tape member required for bending the net guide.

In addition, the aforementioned net guide is formed by inserting the tape member into the insertion devices of the plurality of guide pieces, troubles to connect the rigid units in sequence as in the case of the conventional net guide in which the rigid units are connected by fitting projections and holes are not necessary, and hence the aforementioned net guide and the sliding screen door having the same may be manufactured easily at low costs as much as possible.

In the aforementioned sliding screen door, since the aforementioned net guide can be adequately slid on the guiding device by the provision of the pair of guide ridge for sliding engagement with a guiding device formed on the floor surface at the doorway of a building on a back surface of the bottom of the aforementioned guide piece, adequate and stable opening and closing operation of the aforementioned net is achieved. In particular, when the aforementioned pair of guide ridges is formed into a hook-shape facing to each other, is slidably engaged in the recessed grooves formed on both sides of the aforementioned guiding device, the aforementioned net guide may be prevented further reliably from bending in the opposite direction and lifting from the floor level in association therewith.

Furthermore, by providing the net retaining piece for preventing the aforementioned net from being separated from the net guide and forming the guide piece of the aforementioned net guide with the engaging projection for engaging with the engaging device on the aforementioned net retaining piece, the aforementioned net is prevented from being separated from the net guide as much as possible even when a relatively strong external force such as wind.

BEST MODE FOR CARRYING OUT THE INVENTION

Figure 1:
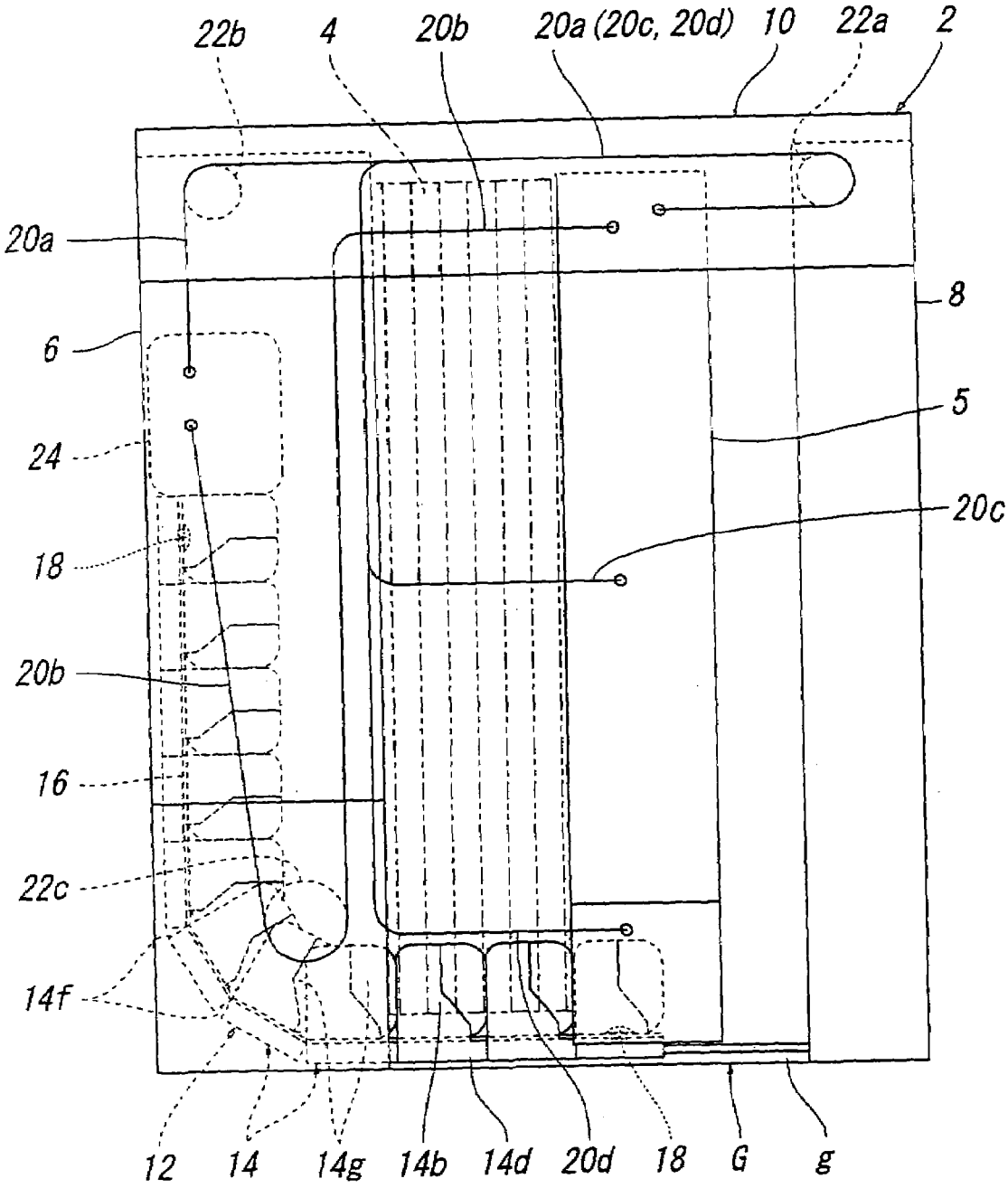
FIG. 1 is a front view schematically illustrating the structure of a sliding screen door according to a first embodiment of the present invention.
Figure 2:
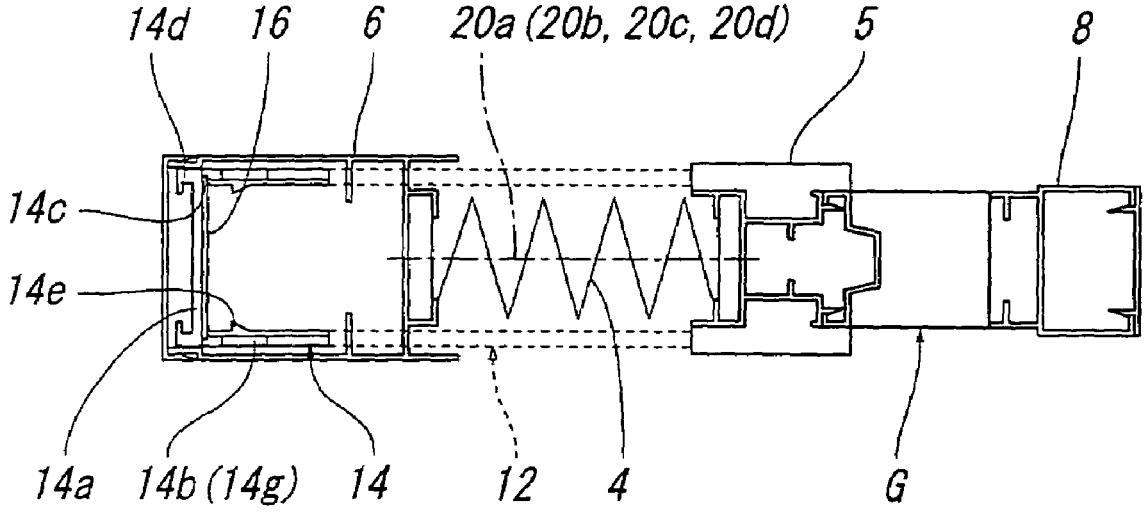
FIG. 2 is a cross sectional plan view of the same.
Figure 3:
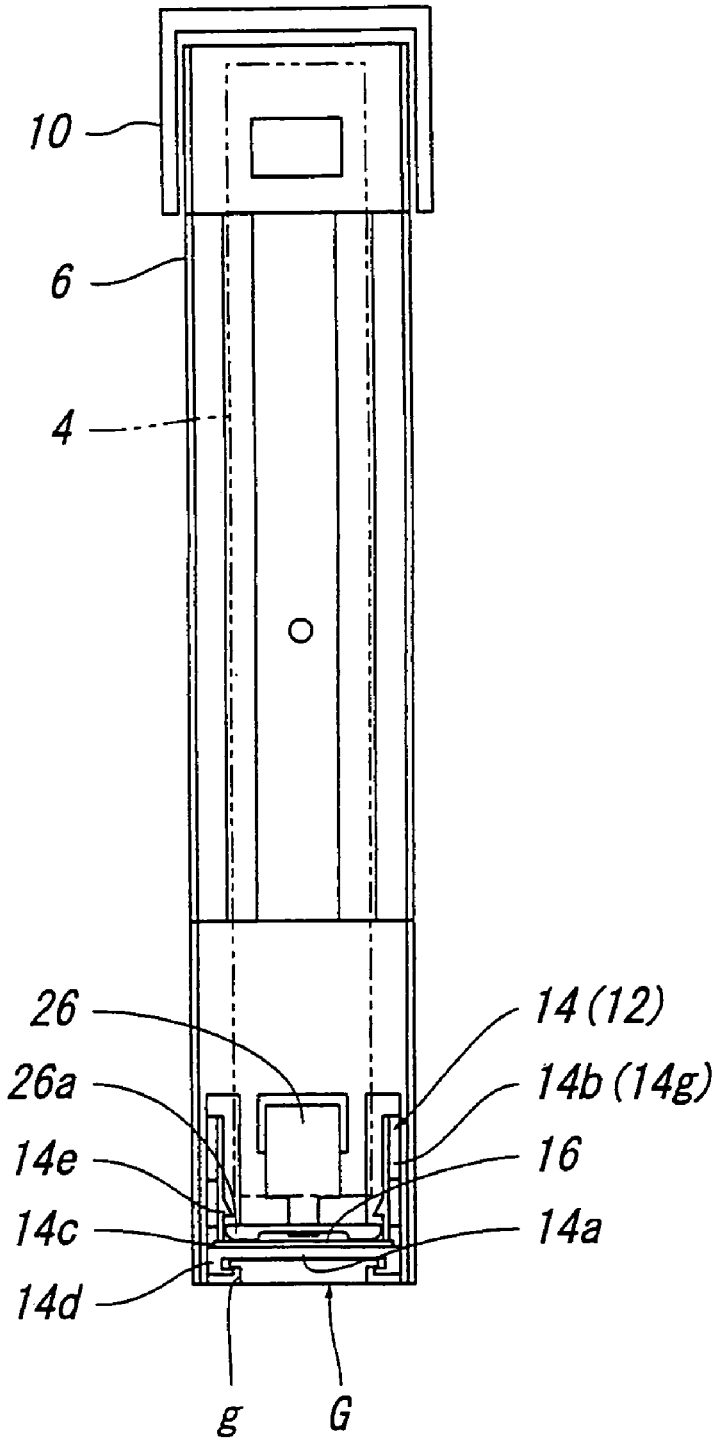
FIG. 3 is a cross sectional side view of the same.

FIG. 1 to FIG. 3 show a first embodiment of a sliding insect-blocking screen door according to the present invention.

This screen door is opened and closed by sliding a net that can be extended like an accordion and, as shown in FIG. 1, generally includes a screen door frame 2, an insect-blocking net 4 attached in the screen door frame 2 so as to be capable of the opening and closing by a sliding movement, and a movable edge member 5 mounted on one end of the net 4 for the opening and closing operation.

The aforementioned screen door frame 2 includes left and right vertical frame members 6 and 8, and an upper horizontal frame member 10, and the screen door frame 2 is provided with a net guide 12, for preventing shaking of the aforementioned net 4 at the lower portion thereof, so as to be fed out from and drawn into the lower end of the aforementioned vertical frame member 6 in association with the movement of the movable edge member 5. The net guide 12 is fixed to the lower end of the movable edge member 5 at one end and is fed out from and drawn into the vertical frame member 6, which is on the left side in the figure, in association with the opening and closing operation of the aforementioned net 4 in association with the movement of the movable edge member, so as to prevent shaking of the lower end of the net 4 due to wind or the like by being drawn out along the lower end of the net in conjunction with the closing operation of the aforementioned net 4 for guiding the lower end of the net in a tensed state.

More specifically, the aforementioned net guide 12 is constructed by connecting a plurality of guide pieces 14 formed of extruded synthetic resin to a relatively thin flexible tape member 16 formed of extruded thermoplastic synthetic resin and having a bending elasticity, as shown in FIG. 1 to FIG. 3.

The flexible tape member 16 having a bending elasticity is not limited to extruded thermoplastic synthetic resin, but may be any material, such as other synthetic resin or metal.

Figure 4:
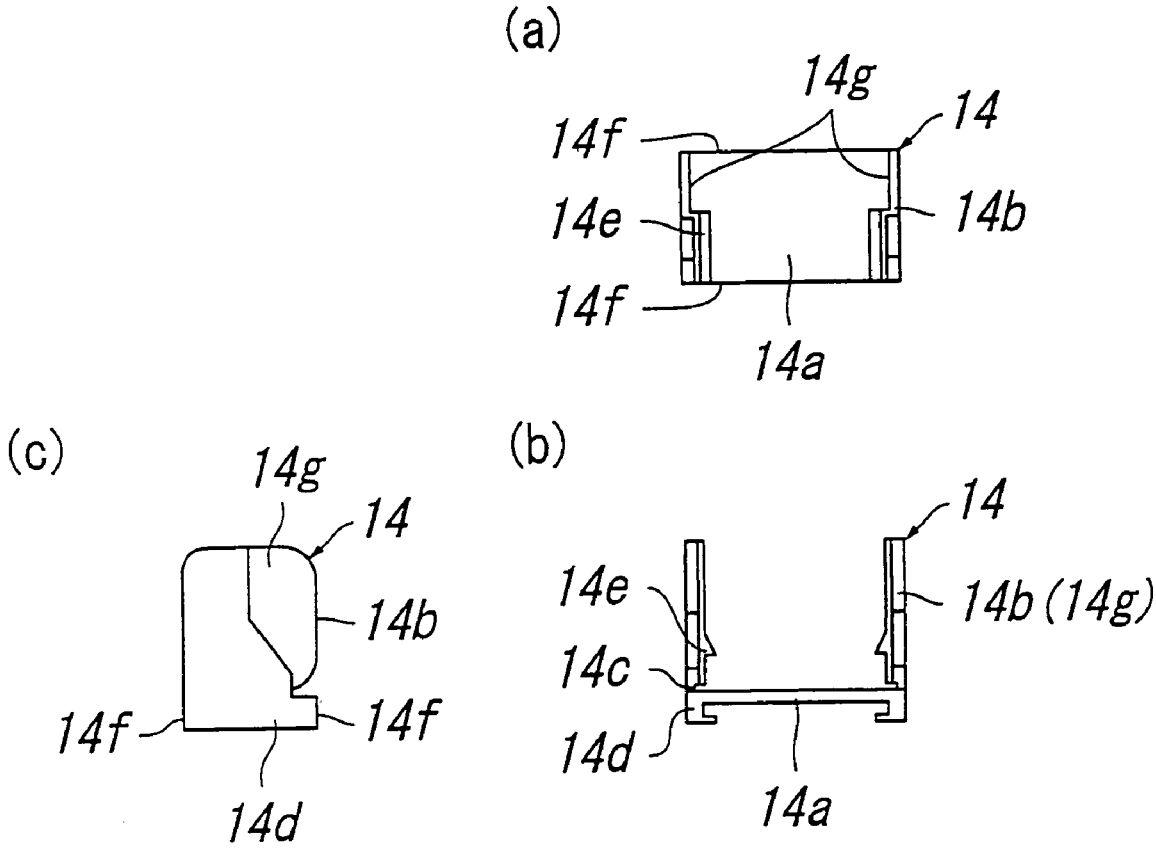
FIG. 4(*a*) is a plan view of a guide piece in the sliding screen door of the first embodiment, (b) is a front view of the same, and (c) is a left side view of the same.

The guide piece 14 forming the aforementioned net guide 12 is formed in to a substantially U-shape, as shown in FIG. 4(*a*) to (*c*), and includes a bottom portion 14*a* extending along the lower edge of the net 4 and a stabilizing portion 14*b* extending upward along the outer periphery of the net 4. A groove-shaped insertion device 14*c* for inserting the tape member 16 is formed at the lower end of the inner surface of the aforementioned stabilizing portion 14*b* along the bottom 14*a* of the guide piece 14. The guide pieces 14 are connected with each other by inserting the tape member 16 through the insertion devices 14*c*, which are formed on the respective guide pieces 14, and the guide pieces 14 at both end of the net guide 12 are fixed to the tape member 16 with pins 18. The guide piece 14 is formed with abutting portions 14*f* formed of a surface facing the direction of connection of the guide piece 14 on both ends in the direction of connection at a position lower than the insertion device 14*c* for the aforementioned tape member 16, and the abutting portion 14*f* constitutes a reverse-warp preventing mechanism for preventing the aforementioned net guide 12 from bending in one direction, that is, into the shape of an upwardly protruding curve.

The guide pieces 14 are connected in such a manner that the abutting portions 14*f* of the adjacent guide pieces 14 abut against each other and the stabilizing portions 14*b* of the adjacent guide pieces 14 are disposed without forming a gap therebetween when the aforementioned net guide 12 is linearly drawn out along the lower end of the net 4 in a stretched state. In this state, the length of the aforementioned tape member 16 is determined to be slightly longer than the total length of the aforementioned plurality of guide pieces 14 in a connected state to an extent that ensures smooth operation of the aforementioned net guide 12. In addition, run-offs 14*g* for accommodating the stabilizing portion 14*b* of the adjacent guide piece 14 when the net guide 12 is bent are formed on the inner surface and the outer surface of both stabilizing portions 14*b* of the guide piece 14. Therefore, as described above, the adjacent guide pieces 14 may be disposed in close proximity, and the aforementioned net guide 12 may be bent to be concave upward, without forming a gap therebetween.

When inserting the aforementioned tape member 16 into the insertion device 14*c* of the guide piece 14, the aforementioned tape member 16 may be inserted easily by inserting the aforementioned tape member 16 into the insertion devices 14*c* of the respective guide pieces 14 in sequence, or by press-fitting the tape member 16 into the space between the stabilizing portions 14*b* of the guide pieces 14 from above. However, without being limited to the methods described above, the plurality of guide pieces 14 may be connected by forming holes along the bottom portions 14*a* of the aforementioned guide pieces 14 and inserting the tape member 16 into the holes.

The aforementioned guide piece 14 is formed of hook-shaped guide ridges 14*d* and 14*d* facing each other on the back surface of the bottom portion 14*a*. The guide ridges 14*d* and 14*d* serve in such a manner that, as clearly shown in FIG. 3, a rail-shaped guiding device G, which has a limited height so as not to interfere with passage, is formed on the floor surface at the doorway of the building, and both of the guide ridges 14*d* and 14*d* are fitting into recessed grooves g on both sides of the guiding device G, so that the aforementioned net guide 12 can adequately slide on the aforementioned guiding device G to enable the aforementioned net 4 to be opened and closed correctly and stably along the guiding device G.

In this embodiment, in order to prevent lifting of the aforementioned net guide as much as possible, the guide ridges 14*d* and 14*d* of the aforementioned guide piece 14 are fitted into the recessed grooves g on both sides of the guiding device G. However, it is not limited to such a construction. In other words, as described above, since the guide pieces 14 of the net guide 12 are connected in such a manner that the abutting portions 14*f* of the adjacent guide pieces 14 abut against each other on the guiding device G, the net guide 12 is prevented from bending to protrude upward. Therefore, impairment of smooth opening and closing operation of the net 4 due to lifting of the net guide 12 from the guiding device G is prevented even without the structure in which the aforementioned guide ridge 14*d* is fitted into the recessed groove g of the guiding device G.

The aforementioned net guide 12 is, as described above, fed out from and drawn into the lower end of the vertical frame member 6 in a bent state in association with the opening and closing of the net 4 for guiding the lower end of the net 4 by being drawn therefrom. In this case, a reaction force generated when the tape member 16 constituting the aforementioned net guide 12 is bent opposes the operating force of the movable edge member 5 as a force for a buffering action. Since the net guide 12 is constructed by connecting the guide pieces 14 by inserting the aforementioned tape member 16 through the insertion device 14*c* on the bottom portion 14*a*, the tape member 16 must be hard enough to resist slipping out from the aforementioned insertion device 14*c* when bent in the longitudinal direction. In view of such-circumstances, an adequate bending elasticity must be provided for the tape member 16 in the aforementioned net guide 12 by selecting the material or by adjusting the thickness.

The aforementioned net 4 can be extended like an accordion by providing a plurality of pleats by folding it alternately back and forth, and is attached to the movable edge member 5 used for opening and closing the vertical frame member 6 of the screen door frame 2 and the net 4 at both ends thereof.

The aforementioned net 4 may be provided at the lower end thereof with a net retaining piece 26 for preventing the net 4 from being separated from the aforementioned net guide 12. The net retaining piece 26 can reliably prevent the aforementioned net 4 from separating from the net guide 12, even when a relatively strong force such as a gust of wind is exerted, by engaging an engaging device 26*a* with the engaging projection 14*e* formed on both of the inner surfaces of the stabilizing portion 14*b* in the aforementioned guide piece 14.

In order to move the movable edge member 5 attached to one end of the aforementioned net 4 stably and in parallel, the movable edge member 5 is provided with a parallel movement mechanism. The parallel movement mechanism is, in the screen door of the present invention, constructed by stretching four tension strings 20*a*, 20*b*, 20*c*, and 20*d* between the vertical frame members 6 and 8, and the screen door frame 2 and the movable edge member 5.

The aforementioned first tension string 20*a* is attached to the upper portion of the movable edge member 5 at one end, passed through the horizontal frame member 10 on top of the screen door frame 2, wound around a rotary element 22*a* provided at the upper part of one of the vertical frame members, to which the net 4 is not attached, that is, the vertical frame member 8, turned back within the horizontal frame member 10, wound around the rotary element 22*b* provided at the upper part of the other vertical frame member 6, guided downward in the vertical frame member 6, and connected at the extremity thereof to a tension string fixing piece 24 attached to the end of the aforementioned net guide 12.

The second tension string 20*b* is attached to the upper end of the aforementioned movable edge member 5 at one end, passed through the net 4, and guided into the vertical frame member 6 to which the aforementioned net 4 is fixed. Then the tension string 20*b* is passed through the vertical frame member 6, guided to the lower end, wound around the rotary element 22*c* provided at the lower part of the vertical frame member 6, guided upward in the vertical frame member 6, and connected to the tension string fixing piece 24 attached to the end of the aforementioned net guide 12 at the distal end thereof.

The third and fourth tension strings 20*c* and 20*d* are attached to the center and the lower end of the aforementioned movable edge member 5, respectively, at one end thereof, and the tension strings 20*c* and 20*d* are passed through the net 4, guided into the vertical frame member 6, to which the aforementioned net 4 is attached, passed through the vertical frame member 6 to the horizontal frame member 10 on top thereof, and then the tension strings 20*c*, 20*d* are introduced through the horizontal frame member 10 to the upper end of the vertical frame member 8, to which the net 4 is not attached, wound around the rotary element 22*a* provided at the upper part of the vertical frame member 8, guided in the opposite direction in the aforementioned horizontal frame member 10, and connected to the upper portion of the aforementioned movable edge member 5 at the distal end thereof.

The rotary elements for the second, third, and forth tension strings 20*b*, 20*c*, and 20*d* are not shown in the drawing.

The portions of the above-described tension strings 20*b*, 20*c*, and 20*d* stretched horizontally across the net 4 are passed through the net 4 for preventing slacking of the net 4 and maintaining the tightness of the net 4. The aforementioned respective rotary elements 22*a* to 22 may be sliding members or pulleys formed of synthetic resin having low resistance.

In the sliding screen door having the aforementioned structure, the aforementioned net guide 12 is constructed by connecting the plurality of guide pieces 14 formed of synthetic resin into a substantially U-shape including the bottom portion 14*a* extending along the lower end of the net 4 and the stabilizing portions 14*b* extending upward along the outer surface of the net 4 by the tape member 16 having bending elasticity and flexibility, and the aforementioned tape member 16 is passed through the insertion devices 14*c* formed along the bottom portions 14*a* of the aforementioned guide pieces 14, and then the guide pieces 14 are fixed at both ends to the tape member 16 with pins 18. Therefore, a reaction force generated by bending the tape member 16 at the connected device between the guide pieces 14 of the aforementioned net guide 12 works as a buffering force against the operating force of the movable edge member 5, and thus a buffering effect may be provided by an adequate resistance without hindering the opening and closing operability of the movable edge member 5.

Since the stabilizing portion 14*b* of the guide piece 14 is accommodated in the run-off 14*g* formed on the stabilizing portion 14*b* of the adjacent guide piece 14 so that the net guide 12 can be bent without forming a gap between the adjacent guide pieces 14, the notches, which have been required for enabling bending of the bottom portion of the net guide in the conventional sliding screen door may be eliminated, and hence its effectiveness as an inset barrier may be improved.

In addition, since the aforementioned net guide 12 is constructed by connecting the plurality of guide pieces 14 by passing the aforementioned tape member 16 through the insertion devices 14*c* formed thereon, trouble to connect the rigid units in sequence, as in the case of the conventional net guide in which the rigid units are connected by fitting together projections and holes, is not necessary, and hence the aforementioned net guide 12 and the sliding screen door having the same may be manufactured easily and as cheaply as possible.

In the aforementioned sliding screen door, the guide ridge 14*d* is formed on the back surface of the bottom portion 14*a* of the aforementioned guide piece 14, and the guide ridge 14*d* is slidably engaged with the recessed grooves g on both sides of the guiding device G provided in the floor surface at the doorway of the building. Therefore, adequate sliding movement of the aforementioned net guide 12, that is, the opening and closing operation of the aforementioned net 4, is achieved stably.

In addition, the aforementioned net 4 is provide with the net retaining piece 26 for preventing the net 4 from separating from the aforementioned net guide 12, and the engaging device 26*a* of the net retaining piece 26 is engaged with the engaging projection 14*e* formed on the guide piece 14 of the aforementioned net guide 12. Therefore, even when a relatively strong force such as a gust of wind is exerted in the direction toward the surface of the net 4, the aforementioned net 4 may be prevented from being separated from the net guide 12 as much as possible.

Figure 5:
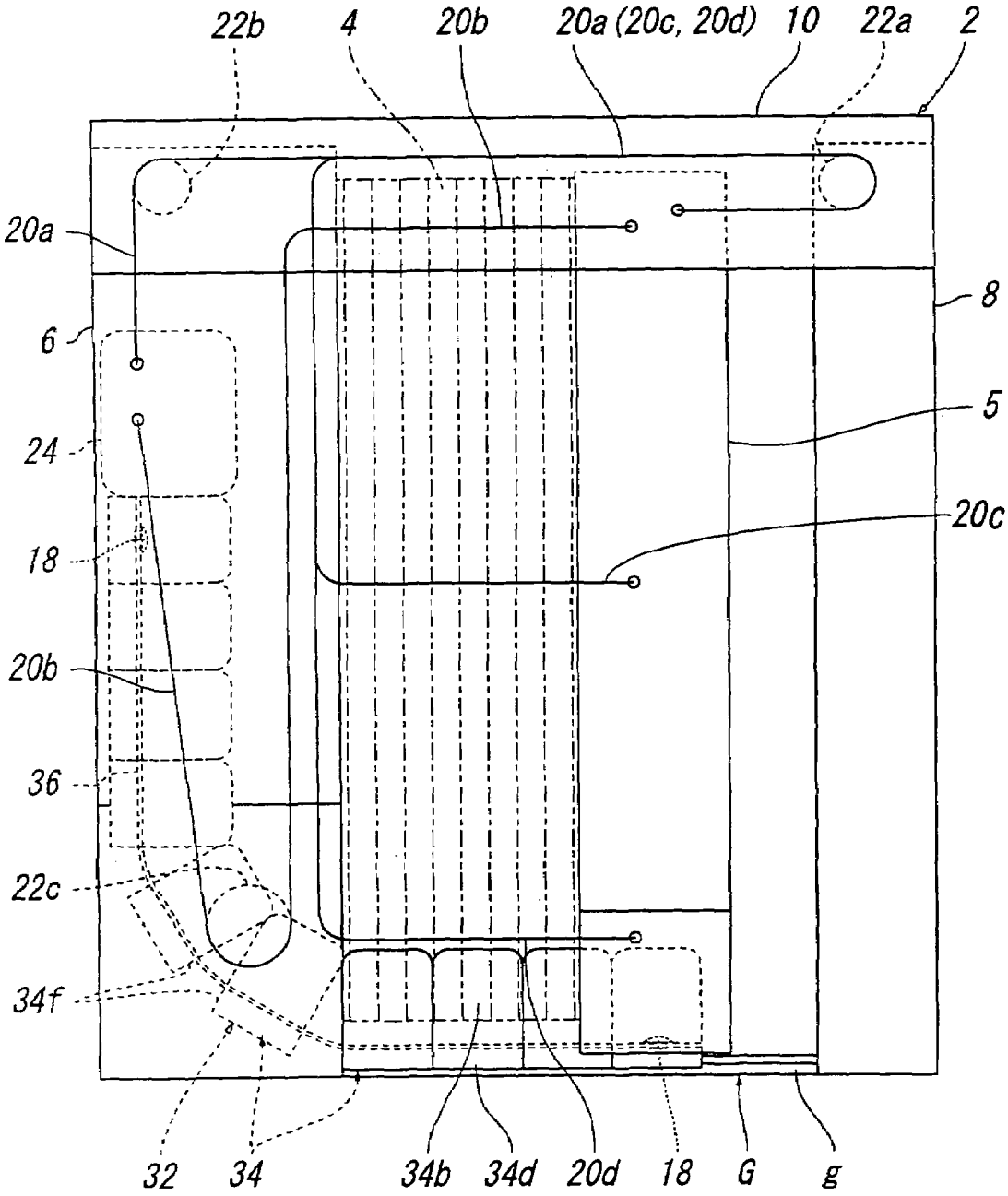
FIG. 5 is a front view schematically illustrating the structure of a sliding screen door according to a second embodiment of the present invention.
Figure 6:
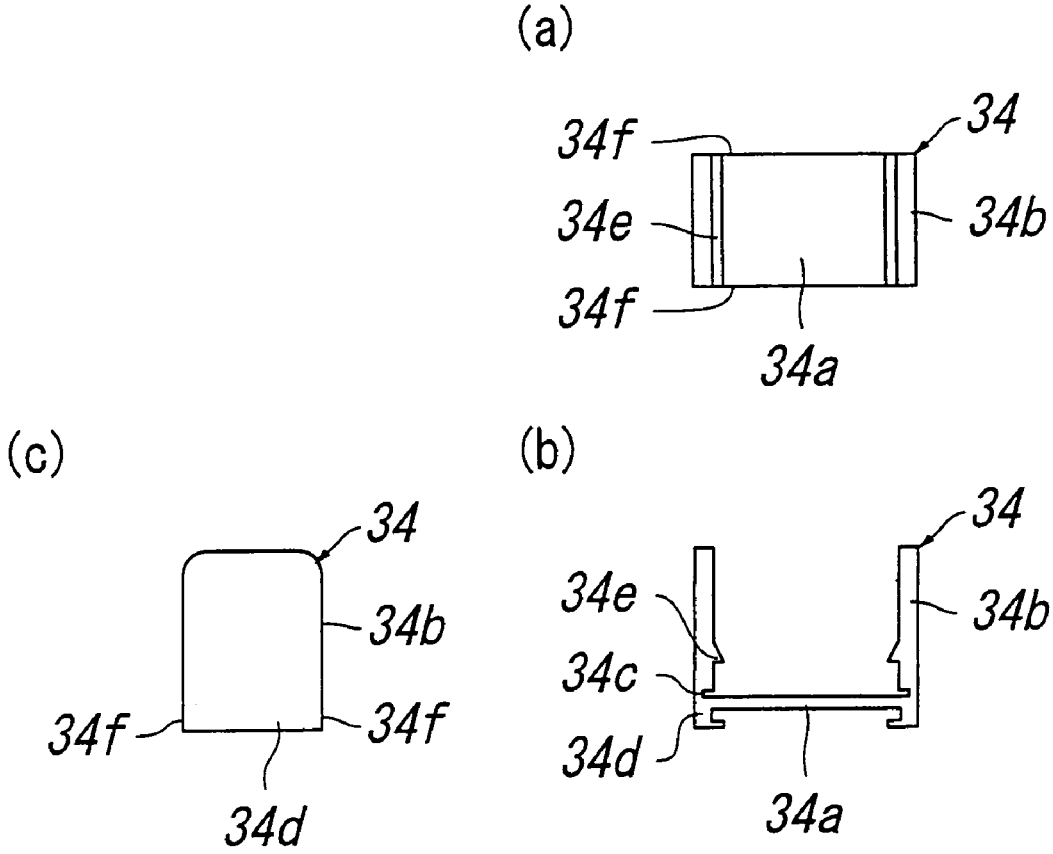
FIG. 6(*a*) is a plan view of a guide piece in the sliding screen door of the second embodiment, (b) is a front view of the same, and (c) is a left side view of the same.

Subsequently, FIG. 5 and FIG. 6 show a second embodiment of the sliding screen door according to the invention.

Although the sliding screen door of the second embodiment is the same as the aforementioned first embodiment in principal structure and, as shown in FIG. 5, guide pieces 34 are connected by the same type of tape member 36 as the aforementioned first embodiment while providing a sufficient length to the tape member 36 for bending a net guide 32 at the position where the net guide 32 is drawn out from the vertical frame member 6. Reference numeral 34*a* in FIG. 6 designates a bottom portion of the guide piece 34, reference numeral 34*c* designates an insertion device of the tape member 36, reference numeral 34*d* designates a guide ridge, and reference numeral 34*f* designates an abutting portion.

In other words, when the aforementioned net guide 32 is bent, the guide pieces 34 and 34 positioned at the bent portion are brought into contact with each other at the upper end corners of stabilizing portions 34*b*, and are separated at the lower ends thereof. Therefore, the length of the aforementioned tape member 36 is longer than the actual length of the plurality of guide pieces 14 in the connected state by a length corresponding to the gap between the guide pieces 34 and 34 positioned at the bent portion of the aforementioned net guide 32. However, these guide pieces 34 are connected in such a manner that the abutting portions 34*f* of the adjacent guide pieces 34 abut against each other and the stabilizing portions 34*b* of the adjacent guide pieces 34 are disposed without forming a gap therebetween when the aforementioned net guide 32 is linearly drawn along the lower end of the net 4 in a stretched state.

Since other structures of the second embodiment are substantially the same as the aforementioned first embodiment, the same parts or the corresponding parts are designated by the same numerals and are not described again.

FIG. 7 to FIG. 11 show a sliding screen door according to a third embodiment of the present invention.

Figure 7:
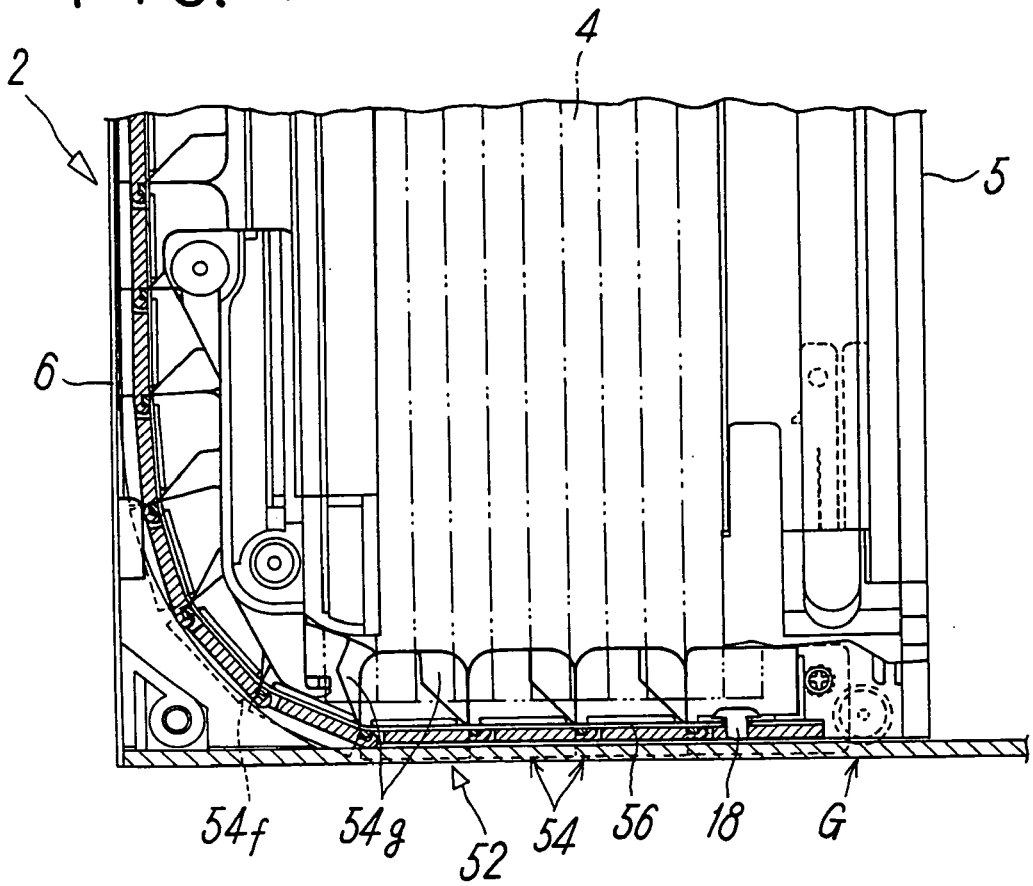
FIG. 7 is a partly exploded front view showing the structure of a sliding screen door according to a third embodiment of the present invention.
Figure 8:
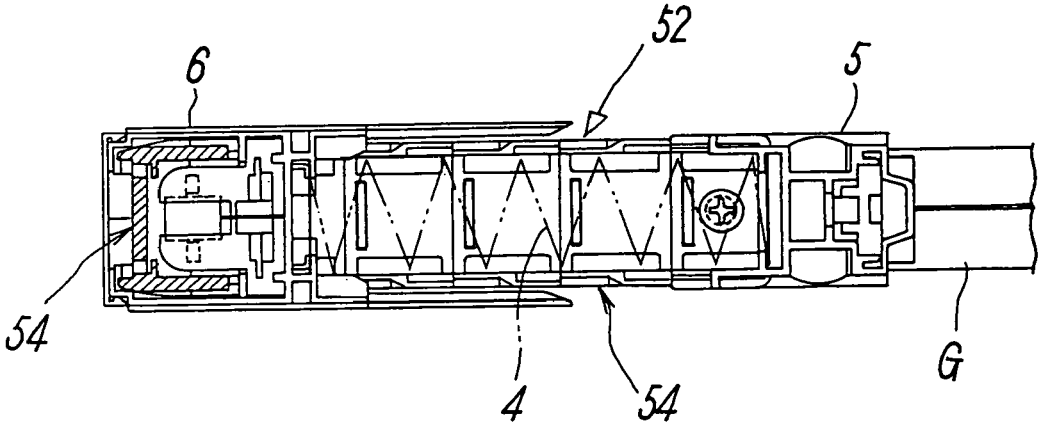
FIG. 8 is a cross sectional plan view of the same.
Figure 9:
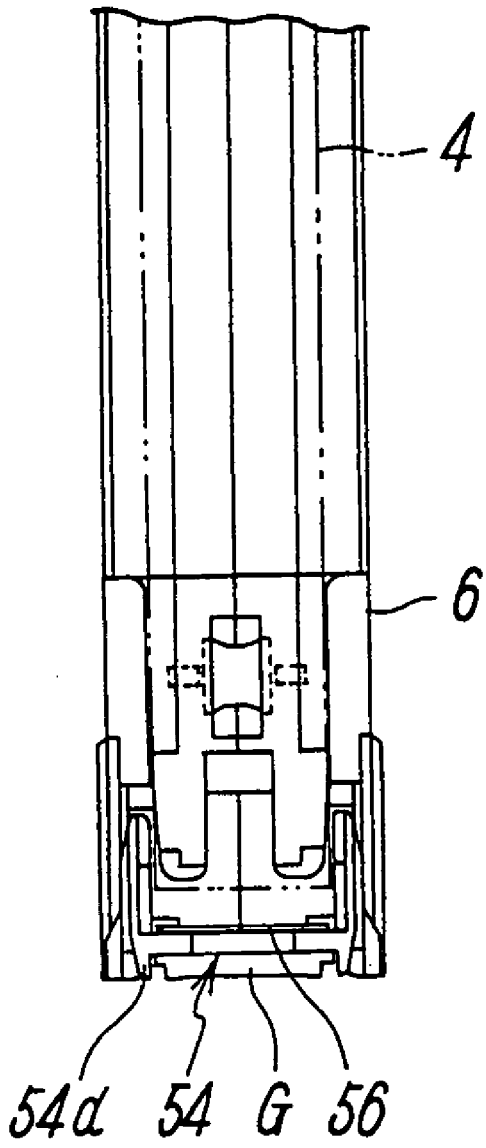
FIG. 9 is a cross sectional side view of the same.

Although the principle structure of the sliding screen door according to the third embodiment is the same as the aforementioned first embodiment and the second embodiment, as shown in FIG. 7, a net guide 52 is constructed by connecting a plurality of guide pieces 54, which are detachably and rotatably connected with each other, and the same type of tape member 56, as the first and the second embodiment is inserted through these guide pieces 54.

The guide pieces 54 positioned at both ends of the net guide 52 are fixed to the aforementioned tape member 56, as in the case of the aforementioned first and second embodiments.

Figure 10:
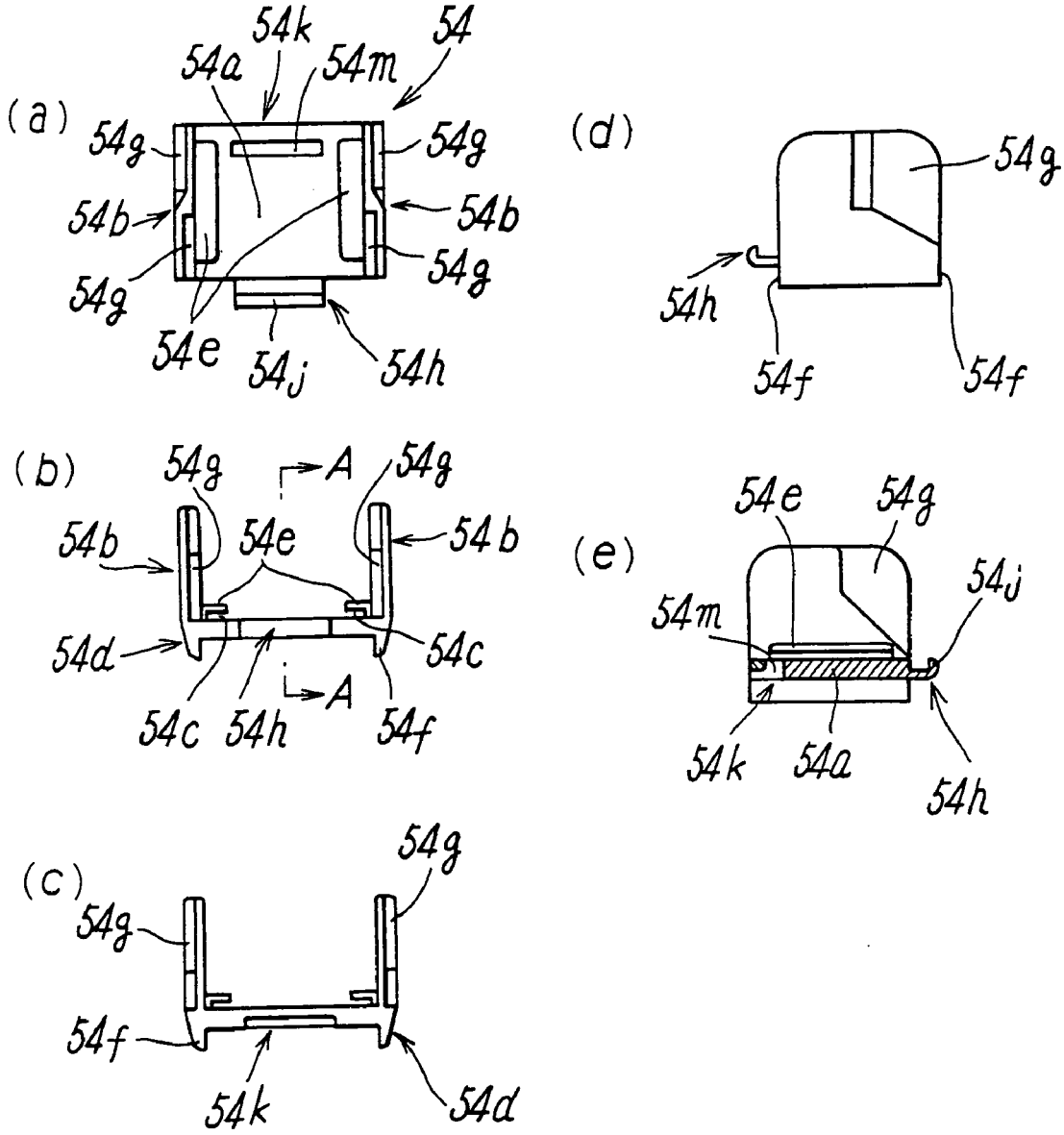
FIG. 10(*a*) is a plan view of a guide piece in the sliding screen door according to the third embodiment, (b) is a front view of the same, (c) is a back view of the same, (d) is a right side view of the same, and (e) is a cross sectional view taken along the line A—A in (b).
Figure 11:
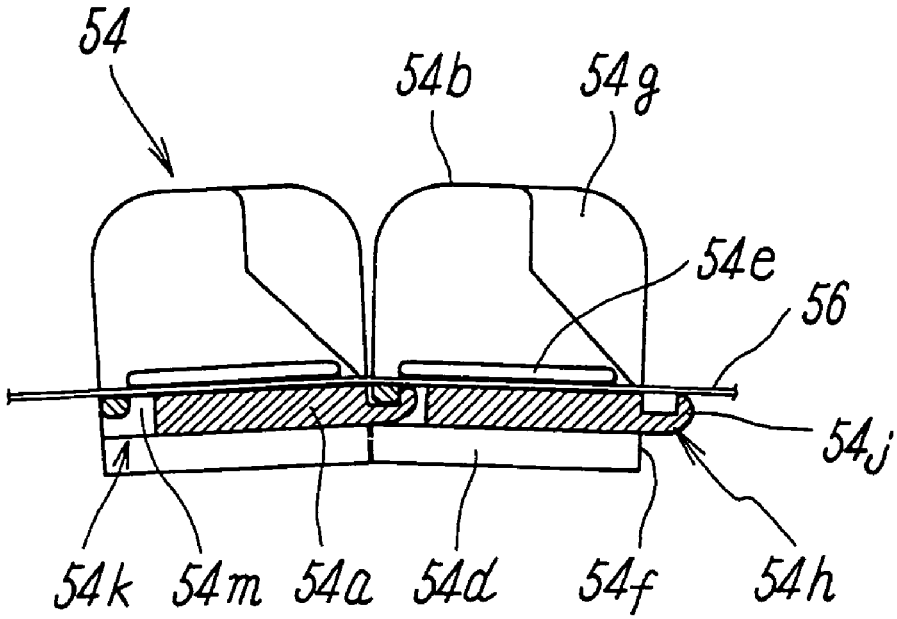
FIG. 11 is a cross sectional side view showing a state in which a force is exerted for bending the net guide according to the third embodiment so as to project upward.

More specifically, the guide pieces 54 constituting the aforementioned net guide 52 are formed into a substantially U-shape, as clearly shown in FIGS. 10(*a*) to (*e*) and FIG. 11, and each include a bottom portion 54*a* extending along the lower end of the net 4 and a pair of stabilizing portions 54*b* extending upward along the outer surface of the net 4. The aforementioned pair of stabilizing portions 54*b* includes projections 54*e* projecting from both of the inner surfaces, and define an insertion device 54*c* for inserting the aforementioned tape member 56 with the surface of the aforementioned bottom portion 54*a*. The pair of stabilizing portions 54*b* are each formed with concaved run-offs 54*g* on the inner surface on one end of the guide pieces 54 in the direction of connection and on the outer surface on the other end thereof for accommodating the pair of stabilizing portions 54*b* of the adjacent guide piece 54 when the net guide 52 is bent, as in the case of the first embodiment.

A hook-shaped connecting strip 54*h* is formed so as to project from one end of the aforementioned bottom 54*a* in the direction of connection of the aforementioned guide pieces 34, and a connected device 54*k* for rotatably and disengageably engaging the aforementioned connecting strip 54*h* on the adjacent guide piece 54 is formed on the other end of the guide piece 54 in the direction of connection. More specifically, the aforementioned connecting strip 54*h* projects from one end surface of the aforementioned bottom portion 54*a* and is bent upward substantially at a right angle at the extremity 54*j* thereof, and the aforementioned connected device 54*k* is formed with a connecting hole 54*m* opened through the front and back surfaces of the aforementioned bottom portion 54*a*. The guide pieces 54 are connected disengageably and rotatably with each other by inserting the extremity 54*j* of the aforementioned connecting strip 54*h* into the connecting hole 54*m* of the connected device 54*k* of the adjacent guide piece 54.

Reference numeral 54*d* in the figure designates a pair of guide ridges provided on the back surface of the aforementioned bottom portion 54*a* for slidably engaging the guiding device G disposed on the floor surface at the doorway of the building, and reference numeral 54*f* designates an abutting portion including a surface formed on the end surface of the aforementioned guide ridge 54*d* so as to face the connecting direction of the guide pieces 54, formed at a position below the aforementioned insertion device 54*c*, the aforementioned connecting strip 54*h*, and the connected device 54*k*.

In this arrangement, as shown in FIG. 7, the aforementioned net guide 52 curves to be concave upward at the position where the net guide 52 is fed into or drawn out from the vertical frame member 6, as in the case of the aforementioned first embodiment and the second embodiment, the abutting portions 54*f* of the adjacent guide pieces 54 are brought into contact with each other, and the stabilizing portions 54*b* of the adjacent guide pieces 54 are disposed so as not to form a gap therebetween when the net guide 52 is linearly drawn out on the guiding device G along the lower end of the net 4 in a stretched state.

As shown in FIG. 11, a bending force causing the net guide 52 to protrude upward, that is, a force to lift the net guide 52 from the aforementioned guiding device G, is exerted, as shown in FIG. 11, the opposed abutting portions 54*f* of the aforementioned adjacent guide pieces 54 are brought into contact with each other, and the extremity 54*j* of the aforementioned connecting strip 54*h* is bought into abutment with and engaged with the inner surface of the connecting hole 54*m* of the aforementioned connected device 54*k* so that rotation of the aforementioned guide piece 54 is prevented. As a consequence, the net guide 52 is reliably prevented from bending so as to project upward. In addition, the aforementioned tape member 56 may also be prevented from expanding, which may occur when such a force is exerted on the net guide 52. In addition, since the guide pieces 54 can be connected easily by disengageably engaging the aforementioned connecting strips 54*h* and the connected device 54*k* with each other in the vertical direction and, simultaneously, inserting the tape member 56 into the aforementioned insertion device 54*c*, the aforementioned net guide 52 and a sliding screen door having the same can be manufactured easily and as cheaply as possible.

In the third embodiment, the extremity 54*j* of the aforementioned connecting strip 54*h* may be bent downward and the aforementioned connecting hole 54*m* is formed in the surface side of the bottom portion 54*a*. It is also possible that the aforementioned pair of guide ridges 54*d* is formed into a pair of hook-shapes opposing each other, and slidably engaged with the recessed grooves formed on both sides of the aforementioned guiding device G, as in the case of the aforementioned first and second embodiments. Furthermore, the aforementioned net retaining piece 26 may be provided at the lower end of the net 4, and the aforementioned engaging projection 14*e* may be provided on the guide piece 54. Though it is not shown in the figure, the tension strings 20*a* to 20*d* are extended in the third embodiment, as in the case of the aforementioned first and the second embodiments.

Other constructions in the third embodiment are substantially the same as those in the aforementioned first and the second embodiments, and the same parts or the corresponding parts are represented by the same reference numerals, and will not be described again.

In the first to third embodiments, it is also applicable to fix one end of the aforementioned net guide 12 (32, 52) to the lower end of the vertical frame member 6, and to allow the other end of the net guide 12 (32, 52) to be fed out from and drawn into the lower end of the movable edge member 5, or to provide another net guide so as to be fed out from and drawn into the vertical frame member 6 (8) or the movable edge member 5 on the aforementioned screen door frame 2, on the net 4 as well as under the net 4. The aforementioned abutting portion 14*f* (34*f*, 54*f*) is not limited to the surface as described above, and may be of any shape and structure as long as it can prevent the net guide 12 (32, 52) from bending so as to project upward.

With the sliding screen door according to the invention described in detail above, in a sliding screen door having a net guide that moves in association with the opening and closing movement of a net, the opening and closing operation of the screen door can be performed smoothly while providing a buffering effect with an adequate resistance, without hindering the opening and closing operability of the movable edge member, by enabling a reaction force of the net guide, which is generated when it is bent, to be used as a buffering force against the operating force of the movable edge member, the net guide being formed by connecting guide pieces formed of a suitable resin.

What is claimed is:

1. A sliding screen door including a net folded alternately back and forth, the net having a first side attached to a vertical frame member of a screen door frame and a second side attached to a movable edge member for an opening and closing operation, the screen door comprising:

a net guide configured to prevent shaking of the net during the closing operation the net guide being provided along a lower end of the net for guiding the lower end of the net, wherein the net guide comprises a plurality of guide pieces formed of synthetic resin into a substantially U-shape each having a bottom portion lying along the lower end of the net and a stabilizing portion extending upward along an outer surface of the net, and a flexible tape member configured to connect the guide pieces, and wherein the tape member is inserted into an insertion device formed along a bottom of each of the guide pieces and the guide pieces at both ends of the net guide are fixed to the tape member.

2. The sliding screen door according to claim 1, wherein the net guide comprises a reverse-warp preventing mechanism configured to prevent the net guide from bending in one direction.

3. The sliding screen door according to claim 2, wherein the reverse-warp preventing mechanism includes an abutting portion provided on each of the guide pieces below the insertion device, the abutting portions of adjacent guide pieces abut against each other when the net guide is linearly drawn out along the lower end of the net.

4. The sliding screen door according to claim 3, wherein the abutting portion is a surface facing a direction of connection of the guide pieces.

5. The sliding screen door according to claim 1, wherein the stabilizing portions of the guide pieces are connected with each other without forming a gap therebetween when the net guide is linearly drawn out along the lower end of the net, and wherein the stabilizing portions each include a run-off portion configured to accommodate the stabilizing portion of an adjacent guide piece when the net guide is bent.

6. The sliding screen door according to claim 1, wherein the stabilizing portions of the guide pieces are connected with each other without forming a gap therebetween when the net guide is linearly drawn out along the lower end of the net, and wherein the tape member has a length that is longer than a total length of the plurality of guide pieces.

7. The sliding screen door according to claim 3, wherein the guide pieces each comprise a hook-shaped connecting strip projecting from above the abutting portion and having an extremity bent upward or downward, and a connected device with which the connecting strip of the adjacent guide piece detachably and rotatably engages, and wherein the stabilizing portion of each of the guide pieces has a run-off portion configured to accommodate the stabilizing portion of the adjacent guide piece when the net guide is bent to allow the net guide to bend.

8. The sliding screen door according to claim 7, wherein the connecting strip projects from an end surface of the bottom portion of the guide piece, and the connected device has a connecting hole on the bottom portion of the guide piece, the extremity of the connecting strip is inserted in the connecting hole.

9. The sliding screen door according to claim 1, wherein the guide piece has a pair of guide ridges for sliding engagement with a guiding device formed on the floor surface of the doorway of a building at a corresponding position of the back surface of the bottom.

10. The sliding screen door according to claim 9, wherein the pair of guide ridges each have a hook-shape so as to slidably engage with a recess groove on both sides of the guiding device.

11. The sliding screen door according to claim 1, wherein a net retaining piece having an engaging device is at the lower end of the net, and an engaging projection configured to engage with the engaging device of the net retaining piece is provided on the guide piece of the net guide.

12. A sliding screen door comprising:

an expandable net;

a door frame having a vertical frame member connected to a first side of said net and a movable edge member connected to a second side of said net; and a net guide supported by said door frame and including a plurality of guide pieces having a substantially U-shape, at least one of said plurality of guide pieces having a bottom portion configured to receive a lower end of said net and a stabilizing portion extending upward along an outer surface of said net, said net guide further including a flexible tape member configured to interconnect said plurality of guide pieces.

13. The sliding screen door according to claim 12, wherein said plurality of guide pieces are interconnected so that said stabilizing portions of adjacent guide pieces are interconnected without forming a gap therebetween when said net guide receives said lower end of said net.

14. The sliding screen door according to claim 12, wherein said least one of said plurality of guide pieces has a run-off portion configured to accommodate a stabilizing portion of an adjacent guide piece when said net guide is bent.

15. The sliding screen door according to claim 12, wherein said tape member has a length that is longer than a total length of said plurality of guide pieces.

16. The sliding screen door according to claim 12, wherein said net guide comprises means for preventing said net guide from bending in one direction.

17. The sliding screen door according to claim 16, wherein said means for preventing includes an abutting portion on each of said plurality of guide pieces below said tape member, so that abutting portions of said adjacent guide pieces abut against each other when said net guide receives said lower end of said net.

18. The sliding screen door according to claim 17, wherein said plurality of guide pieces each comprise a hook-shaped connecting strip projecting from above said abutting portion and having an extremity bent upward or downward, and a connected device with which said connecting strip of an adjacent guide piece detachably and rotatably engages, and wherein said stabilizing portion of each of said plurality of guide pieces has a run-off portion configured to accommodate a stabilizing portion of an adjacent guide piece when said net guide is bent.

19. The sliding screen door according to claim 12, wherein said at least one of said plurality of guide pieces has a pair of guide ridges configured to slidably engage a guiding device on a floor, and wherein said pair of guide ridges have a hook-shape configured to slidably engage a recess groove on the guiding device.

20. The sliding screen door according to claim 12, wherein said lower end of said net has a net retaining piece having an engaging device, and wherein said at least one of said plurality of guide pieces has an engaging projection configured to engage with said engaging device.

* * * * *